US009869171B2

(12) United States Patent
Chen

(10) Patent No.: US 9,869,171 B2
(45) Date of Patent: Jan. 16, 2018

(54) NANOFIBER STRAIN GAUGE SENSORS IN DOWNHOLE TOOLS

(71) Applicant: Halliburton Energy Services, Inc., Houston, TX (US)

(72) Inventor: Hau Jiun Chen, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 230 days.

(21) Appl. No.: 14/764,589

(22) PCT Filed: Jul. 25, 2014

(86) PCT No.: PCT/US2014/048232

§ 371 (c)(1),
(2) Date: Jul. 30, 2015

(87) PCT Pub. No.: WO2016/014080

PCT Pub. Date: Jan. 28, 2016

(65) Prior Publication Data

US 2016/0265337 A1 Sep. 15, 2016

(51) Int. Cl.
*E21B 44/02* (2006.01)
*E21B 10/00* (2006.01)
(Continued)

(52) U.S. Cl.
CPC ..... *E21B 44/02* (2013.01); *E21B 10/00* (2013.01); *E21B 10/08* (2013.01); *E21B 44/005* (2013.01);
(Continued)

(58) Field of Classification Search
CPC ..... E21B 44/02; E21B 10/00; E21B 10/08; E21B 44/005; E21B 47/0006; E21B 4/00;
(Continued)

(56) References Cited

U.S. PATENT DOCUMENTS 4,785,894 A * 11/1988 Davis, Jr. ..... E21B 12/02 175/39
5,842,149 A 11/1998 Harrell et al.
(Continued)

FOREIGN PATENT DOCUMENTS

WO 2009135119 A2 11/2009
WO 2012165839 A2 12/2012
(Continued)

OTHER PUBLICATIONS

Pang et al., A Flexible and Highly Sensitive Strain-Gauge Sensor Using Reversible Interlocking of Nanofibres, Nature Materials, vol. 11, Sep. 2012.
(Continued)

*Primary Examiner* — Yong-Suk (Philip) Ro
(74) *Attorney, Agent, or Firm* — McDermott Will & Emery LLP

(57) ABSTRACT

A downhole drilling tool may include a strain gauge inside a rolling-bearing element. For example, the downhole drilling tool may include a rolling-bearing element having an inner race, an outer race, and one or more bearings disposed between the inner and outer races; and a strain gauge disposed on an interior surface of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection.

20 Claims, 10 Drawing Sheets

(51) Int. Cl.

| | |
|---|---|
| ***E21B 47/00*** | (2012.01) |
| ***E21B 10/08*** | (2006.01) |
| ***E21B 44/00*** | (2006.01) |
| *E21B 4/00* | (2006.01) |
| *E21B 7/04* | (2006.01) |
| *E21B 17/02* | (2006.01) |
| *E21B 17/05* | (2006.01) |
| *E21B 17/10* | (2006.01) |

(52) U.S. Cl.
CPC ..... *E21B 47/0006* (2013.01); *E21B 4/00* (2013.01); *E21B 7/04* (2013.01); *E21B 17/021* (2013.01); *E21B 17/05* (2013.01); *E21B 17/1057* (2013.01); *E21B 17/1078* (2013.01)

(58) Field of Classification Search
CPC ..... E21B 7/04; E21B 17/021; E21B 17/05; E21B 17/1057; E21B 17/1078; E21B 12/04; E21B 7/00
See application file for complete search history.

(56) References Cited

U.S. PATENT DOCUMENTS

| | | | |
|---|---|---|---|
| 5,952,587 | A | 9/1999 | Rhodes et al. |
| 8,245,793 | B2 | 8/2012 | Trinh et al. |
| 2006/0032674 | A1 | 2/2006 | Chen et al. |

FOREIGN PATENT DOCUMENTS

| | | | |
|---|---|---|---|
| WO | 2013101984 | A2 | 7/2013 |
| WO | 2016014080 | A1 | 1/2016 |

OTHER PUBLICATIONS

Pang et al., A Flexible and Highly Sensitive Strain-Gauge Sensor Using Reversible Interlocking of Nanofibres, Supplementary Information. Nature Materials, 2012.
International Search Report and Written Opinion for PCT/US2014/048232 dated Apr. 21, 2015.

* cited by examiner

NANOFIBER STRAIN GAUGE SENSORS IN DOWNHOLE TOOLS

BACKGROUND

The present application relates to measuring loads applied to downhole tools during drilling operations.

Downhole tools used in the exploration and production of hydrocarbons, such as drilling tools, may be equipped with several sensors to detect rotational speed, acceleration, torque, bending moment, vibration, and weight-on-bit. The data from these sensors may assist operators with optimizing drilling parameters to enhance drilling performance and efficiency. In many instances, these sensors are clustered in sections of a drill string, such as in a drill collar or other measurement sub. As clustered together, the sensors may end up measuring the various operational parameters indirectly based on the mechanical loads experienced uphole of the drill bit.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present application relates to measuring loads applied to downhole tools during drilling operations. More specifically, the application relates to strain gauge sensors (also referred to as "strain gauges") that can be implemented inside a rolling-element bearing.

The exemplary strain gauges described herein are generally flexible and thin with a large surface area, which allows for use of the strain gauges on an interior surface of a rolling-element bearing. Measuring loads experienced in the interior of the rolling-element bearing may provide a more accurate measurement of the loads experience by a downhole tool (e.g., weight-on-bit, torque, etc.).

Additionally, the strain gauges described herein can be configured to measure the magnitude of an applied load and correlate it to the location of the applied load. Therefore, uneven loading on a rolling-element bearing may be determined with the systems and methods described herein. In some instances, where an uneven load is undesirable, an operator may take remedial action to correct or reduce the uneven load.

Additionally, the strain gauges described herein may be disposed on interior surfaces of a rolling-element bearing to directly measure the forces exerted on the races by the bearings.

Figure 1:
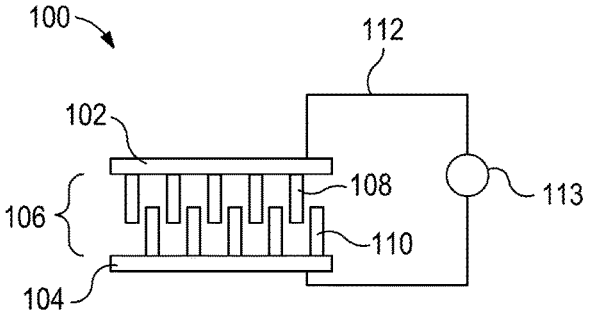
FIG. 1 provides a schematic diagram of a circuit of a strain gauge suitable for use in downhole tools according to at least some embodiments described herein.

FIG. 1 provides a schematic diagram of a circuit 100 of an exemplary strain gauge suitable for use in downhole tools. The circuit 100 includes a first substrate 102, a second substrate 104, and a gap 106 defined therebetween. The first and second substrates 102,104 have intermingling first and second conductive fibers 108,110, respectively, extending therefrom and into the gap 106. For illustrative purposes, the first and second conductive fibers 108,110 are shown as not touching in a radial direction. However, one of skill in the art would recognize that the first and second conductive fibers 108,110 are in contact with each other to complete the circuit 100.

The first and second substrates 102,104 may be communicably coupled to each other via an electrical connection 112 that completes the circuit 100. The electrical connection 112 may be a wired or wireless connection between the first and second substrates 102,104 to communicably couple the two components.

Application of pressure, shear, torsion, or a combination thereof to one or both of the first and second substrates 102,104 may cause a change in the strain on individual conductive fibers 108,110, a change in the amount of contact between the first and second conductive fibers 108,110, or both. These changes in strain, degree of contact, or both may affect the electrical resistance of the circuit 100, which can be measured with an electrical resistance sensor 113 arranged within circuit 100 and otherwise in the electrical connection 112. This change in electrical resistance may be measured and correlated to an applied load (e.g., pressure, shear, torsion, or a combination thereof). The relationship between the electrical resistance and the applied load may be determined via routine experimentation and may depend on, inter alga, the composition of the first and second substrates 102,104, the composition of the conductive fibers 108,110, the temperature of the circuit 100, or a combination thereof.

Regarding the electrical connection 112 and electrical resistance sensor 113, one skilled in the art will readily recognize the configurations of leads and other components of the electrical connection 112 needed to connect the circuit 100 to the electrical resistance sensor 113, which may be similar in design to circuit boards in computers.

In some instances, a single resistance sensor 113 may be used for measuring a single circuit 100. In other instances, a single resistance sensor 113 may be used for measuring multiple circuits 100 (e.g., by cycling between the measurements of individual circuits 100).

Figure 2:
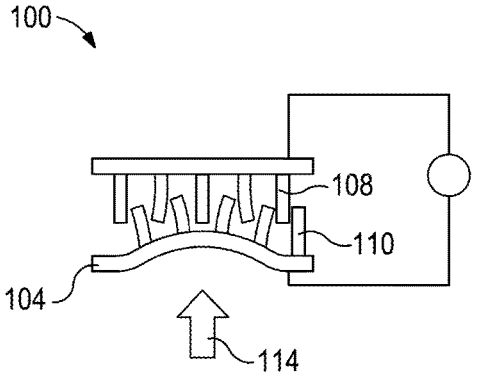
FIG. 2 provides a schematic diagram of the circuit of FIG. 1 with pressure applied to the second substrate.

FIG. 2 provides a schematic diagram of the circuit 100 of FIG. 1 with pressure 114 applied to the second substrate 104. As illustrated, the amount of contact between the first and second conductive fibers 108,110 increases where the pressure 114 is applied to the second substrate 104. Further, in response to the applied pressure 114, some of the first and second conductive fibers 108,110 may deform (e.g., bend or crimp). The foregoing changes to the first and second conductive fibers 108,110 and their interactions may result in a change to the electrical resistance of the circuit 100.

Figure 3:
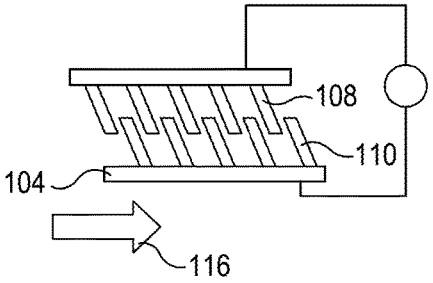
FIG. 3 provides a schematic diagram of the circuit of FIG. 1 with shear applied to the second substrate.

FIG. 3 provides a schematic diagram of the circuit 100 of FIG. 1 with lateral shear 116 applied to the second substrate 104. As illustrated, the amount of contact between the first and second conductive fibers 108,110 decreases and the first and second conductive fibers 108,110 deform (e.g., bend) because of the shear 116, which may change the electrical resistance of the circuit 100.

Figure 4:
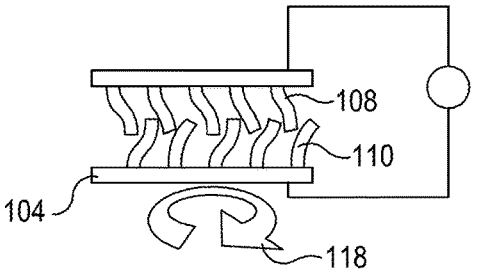
FIG. 4 provides a schematic diagram of the circuit of FIG. 1 with torsion applied to the second substrate.

FIG. 4 provides a schematic diagram of the circuit 100 of FIG. 1 with torsion 118 applied to the second substrate 104. As illustrated, the amount of contact between the first and second conductive fibers 108,110 decreases and the first and second conductive fibers 108,110 deform (e.g., bend or twist) because of the torsion 118, which may change the electrical resistance of the circuit 100.

In some embodiments, combinations of the foregoing loads (i.e., pressure, lateral shear, and torsion) may be experienced and analyzed with the circuits 100 and strain gauges described herein.

The conductive fibers 108,110 may be grown or otherwise formed on their respective substrates 102,104. In some instances, the structure of the conductive fibers 108,110 may be formed of a nonconductive material that is then coated with a conductive material to produce the conductive fibers 108,110. The coating facilitates electrical conductivity between the substrates 102, 104 of the circuit 100 via the conductive fibers 108, 100. In these instances, the substrates 102,104 may be conductive or nonconductive. In instances, where the substrate 102,104 is nonconductive, the electrical connection 112 is coupled to the conductive coating.

In some embodiments, the structure of the conductive fibers 108,110 may be formed of a conductive material. When used in conjunction with a nonconductive substrate, the conductive fibers 108,110 formed of a conductive material should be coated with a conductive material. When used in conjunction with a conductive substrate, the conductive fibers 108,110 formed of a conductive material may optionally be coated with a conductive material.

Generally, the materials used to form the conductive fibers 108,110 and the substrates 102,104 should be flexible, yet have a sufficient modulus to function at the temperatures and pressures experienced in a rolling-element bearing of a downhole tool. Such temperatures and pressures may depend on, inter alia, the downhole tool, the operating conditions, and the downhole conditions. For example, a rolling-element bearing in a roller-cone drill bit may experience higher temperatures and pressures than a rolling-element bearing in a bent pipe used in directional drilling.

Exemplary nonconductive materials suitable for use in forming the structure of conductive fibers 108,110 may include, but are not limited to, polyurethane, polytetrafluoroethylene (PTFE), polyethylene terephthalate (PET), polyethylene, polypropylene, and the like, and any combination thereof.

Exemplary conductive materials suitable for use in forming the structure of conductive fibers 108,110 may include, but are not limited to, single-walled carbon nanotubes, multiwalled carbon nanotubes, carbon whiskers, polyphenylenes, polypyrenes, polypyrroles, and the like, and any combination thereof.

Exemplary conductive materials suitable for coating a nonconductive or conductive material used in forming at least a portion of the conductive fibers 108,110 may include, but are not limited to, platinum, gold, tungsten, graphene, and the like, and any combination thereof. As used herein, the term "graphene" encompasses graphite of one to three graphene layers thick of any two dimensional shape (e.g., flakes, ribbons, etc.).

Exemplary nonconductive materials suitable for the substrates 102,104 may include, but are not limited to, polydimethylsiloxane (PDMS), PTFE, PET, polyethylene, polypropylene, silicone rubber, and the like, and any combination thereof.

Forming the structure of the conductive fibers 108,110 may be achieved by any suitable methods. For example, polymer structures may be formed by templating methods where a template with holes is produced that is infiltrated with the polymer and removed to leave the structure of the conductive fibers 108,110. In another example, carbon nanotubes may be grown in an array via chemical vapor deposition methods. Additional methods for growing or otherwise producing conductive fibers 108,110 in an array may include arc sputtering, laser sputtering, 3-dimensional printing, and the like, and any hybrid thereof.

Conductive fibers 108,110 may have a height extending from the substrates 102,104 ranging from a lower limit of 100 nm, 250 nm, 1 micron or 10 microns to an upper limit of 100 microns, 50 microns, 10 microns, or 1 micron, wherein the height may range from any lower limit to any upper limit (provided the lower limit is less than the upper limit) and encompasses any subset therebetween. Conductive fibers 108,110 may have a diameter of 1 nm to 10 microns ranging from a lower limit of 1 nm, 10 nm, 25 nm, 100 nm, or 250 nm to an upper limit of 10 microns, 1 micron, 500 nm, or 250 nm, wherein the diameter may range from any lower limit to any upper limit (provided the lower limit is less than the upper limit) and encompasses any subset therebetween.

Forming a coating on the structure of the conductive fibers 108,110 may be achieved by any suitable methods such as, but not limited to, sputter coating, electroless plating, electroplating, thermal evaporation, and the like.

The exemplary strain gauges described herein may include one or more circuits 100. As will be appreciated, multiple circuits 100 may be useful in providing additional spatial information regarding where a load is applied to a strain gauge.

Figure 5:
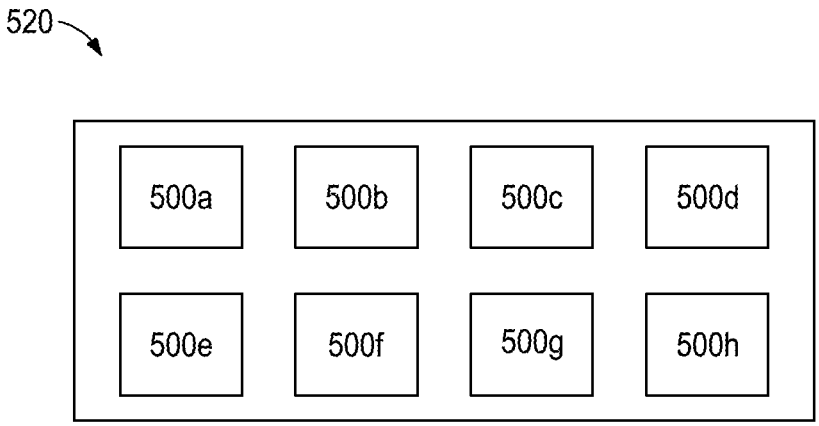
FIG. 5 provides an illustrative layout of a strain gauge according to at least some embodiments described herein that includes a 2×4 array of eight circuits.

FIG. 5, for example, provides an illustrative layout of an exemplary strain gauge 520 that includes a two-by-four array of eight circuits 500*a-h*. Each of the circuits 500*a-h* may be similar to the circuit 100 of FIGS. 1-4.

Figure 6:
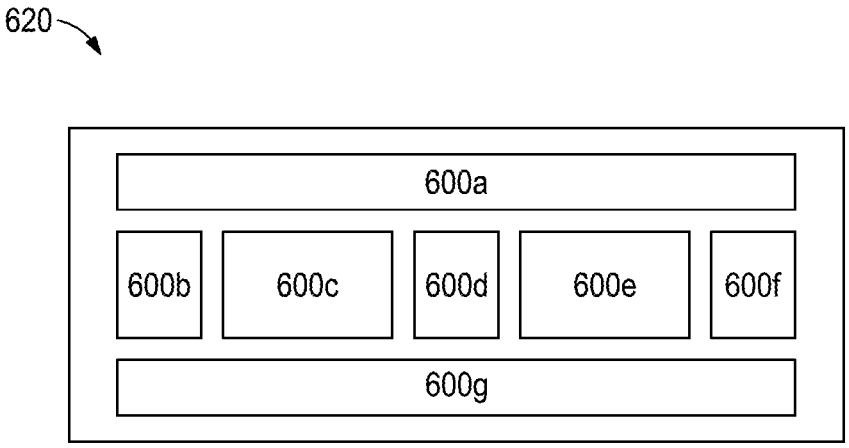
FIG. 6 provides an illustrative layout of a strain gauge according to at least some embodiments described herein that includes an array of seven circuits individually sized and arranged in the strain gauge.

FIG. 6 provides an illustrative layout of an exemplary strain gauge 620 that includes an array of seven circuits

600*a-g* individually sized and arranged in the strain gauge 620. Again, each of the circuits 600*a-g* may be similar to the circuit 100 of FIGS. 1-4. As illustrated, the circuits 600*a-g* are arranged in three rows with the top and bottom rows each including only one circuit 600*a,g*, respectively. The middle row includes circuits 600*b-f* in series with circuits 600*b, d, f* at about half the width of circuits 600*c,e*.

Individually sizing and arranging the circuits 600*a-g* in the strain gauge 620 may prove useful in reducing manufacturing costs. For example, multiple smaller circuits, like those illustrated at 600*b-f*, may be useful in an area where precise strain measurements coupled to a precise location is needed. While fewer, larger circuits like those illustrated at 600*a,g* may be useful in areas where the presence or absence of a load is important (e.g., when the presence or absence of the load indicates failure or imminent failure of a downhole tool).

With continued reference to FIGS. 1, 5, and 6, in some instances, the first and second conductive fibers 108,110 may be grown or otherwise formed in patterns on the first and second substrates 102,104 for producing distinct circuits 500*a-h*, 600*a-g* in corresponding strain gauges 520, 620. It should be noted that by forming distinct circuits 500*a-h* and 600*a-g* in such a manner, nonconductive substrates 102,104 and a conductive coating on the first and second conductive fibers 108,110 of distinct circuits 500*a-h* and 600*a-g* should be used to electrically isolate the individual circuits 500*a-h* and 600*a-g*.

In some instances, the individual circuits 500*a-h* and 600*a-g* may be assembled onto a support to produce the corresponding strain gauges 520,620.

In some embodiments, a combination of the foregoing may be used where the first and second conductive fibers 108,110 may be grown or otherwise formed in patterns on the first and second substrates 102,104 to produce distinct circuits 500*a-h*, 600*a-g*, and the first and second substrates 102,104 may be disposed on a support.

Figure 7:
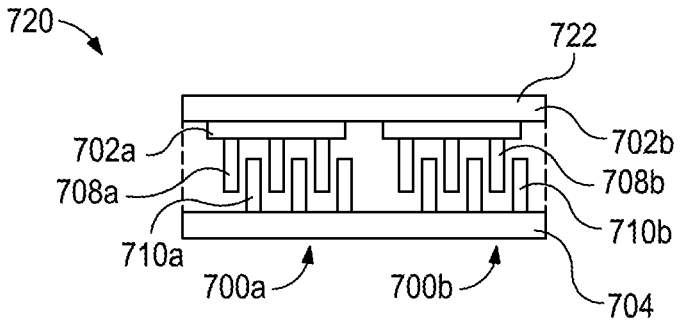
FIG. 7 provides a schematic diagram of a portion of a strain gauge according to at least some embodiments described herein with two circuits.

FIG. 7 provides a schematic diagram of a portion of an exemplary strain gauge 720 having two circuits 700*a,b*. Each circuit 700*a,b* includes a first substrate 702*a,b*, each having first conductive fibers 708*a,b* disposed thereon, respectively, with the first substrates 702*a,b* disposed on a support 722. As illustrated, the first conductive fibers 708*a,b* intermingle with first conductive fibers 710*a,b* extending from a single second substrate 704.

Generally, the support 722 may be formed of a nonconductive material that electrically isolates the circuits 700*a,b* and has sufficient mechanical strength to support the circuits 700*a,b*. In some embodiments, the support 722 may also be sufficiently flexible to allow for any forces assumed by the support 722 to be transmitted therethrough and to the substrates 702*a,b* attached thereto. In some instances, the support 722 may also function to reduce or eliminate wear on the corresponding substrates 702*a,b*.

Exemplary nonconductive materials suitable for forming the support 722 may include, but are not limited to, polydimethylsiloxane (PDMS), PTFE, PET, polyethylene, polypropylene, silicone rubber, aramid fibers (e.g., KEVLAR®), and the like, and any combination thereof.

The strain gauges described herein (e.g., strain gauges similar to those describe at reference numbers 520, 620, 720 of FIGS. 5-7) may be included in various downhole tools that incorporate or rely on rolling-element bearings. Examples of rolling-element bearings may include ball bearings, cylindrical roller bearings, spherical roller bearings, tapered roller bearings, toroidal roller bearings, and the like. In some instances, rolling-element bearings may be configured to assume two kinds of loading, radial and thrust. Depending on where the rolling-element bearing is being used, it may experience all radial loading, all thrust loading, or a combination of both.

Figure 8A:
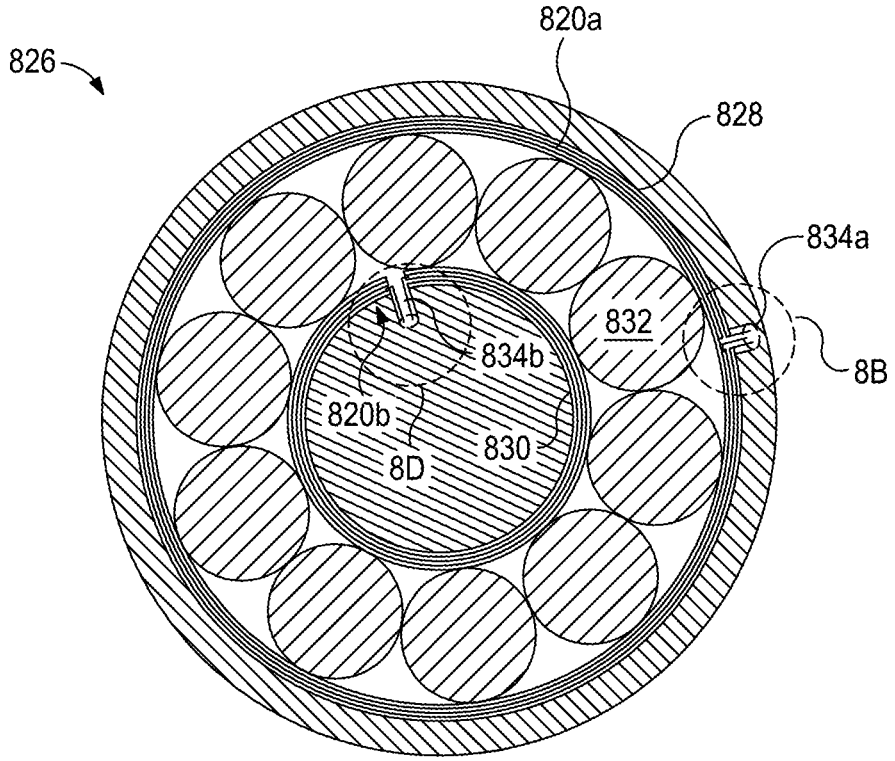
FIG. 8A provides a schematic diagram of a rolling-element bearing according to at least some embodiments described herein with a first strain gauge disposed on an outer race of the rolling-element bearing and a second strain gauge disposed on an inner race of the rolling-element bearing.

FIG. 8A provides a schematic diagram of a rolling-element bearing 826 with a first strain gauge 820*a* disposed on an outer race 828 of the rolling-element bearing 826 and a second strain gauge 820*b* disposed on an inner race 830 of the rolling-element bearing 826. The rolling-element bearing 826 further includes bearings 832 disposed between the inner and outer races 830,828. The outer race 828 may include a port 834*a* configured to receive and pass an electrical connection (illustrated as a wired electrical connection in FIG. 8B-C). Similarly, the inner race 830 may include a port 834*b* configured to receive and pass an electrical connection (illustrated as a wired electrical connection in FIG. 8D).

Figure 8B:
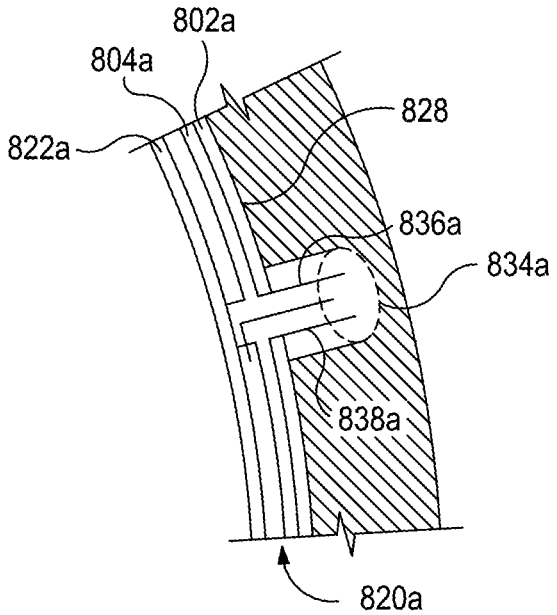
FIG. 8B provides an expanded view of the rolling-element bearing of FIG. 8A of the first strain gauge disposed on the outer race at a port.

FIG. 8B provides an expanded view of a portion of the first strain gauge 820*a* of FIG. 8A as disposed on the outer race 828 at port 834*a*. As illustrated, the strain gauge 820*a* includes a first substrate 802*a* disposed on the outer race 828 and a second substrate 804*a* radially offset therefrom towards the inner race 830 and otherwise disposed on a support 822*a*. Electrical connections 836*a*,838*a* may extend from the first and second substrates 802*a*,804*a*, respectively, and into the port 834*a*.

Figure 8C:
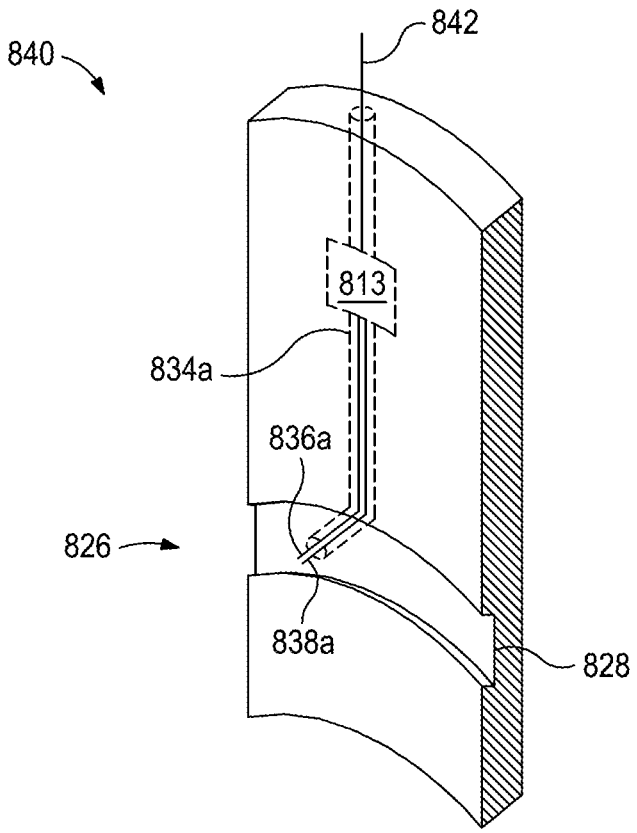
FIG. 8C provides a perspective illustration of a portion of downhole tool with the rolling-element bearing of FIG. 8A.

FIG. 8C provides a perspective illustration of a portion of an exemplary downhole tool 840 that incorporates the rolling-element bearing 826 of FIG. 8A. Illustrated are the outer race 828 and the port 834*a*. As illustrated, the port 834*a* is communicably coupled to the outer race 828 and extends axially within a wall of the downhole tool 840. The electrical connections 836,838 extend within the port 834 to an electrical resistance sensor 813, where the resistivity of individual circuits of the strain gauge 820*a* may be measured and optionally analyzed. The measurements and optional analysis may then be transmitted to the surface via wired communication, wireless communication, or a hybrid thereof. As illustrated, a communication line 842 axially extends through the port 834 and towards a surface location (not shown).

Figure 8D:
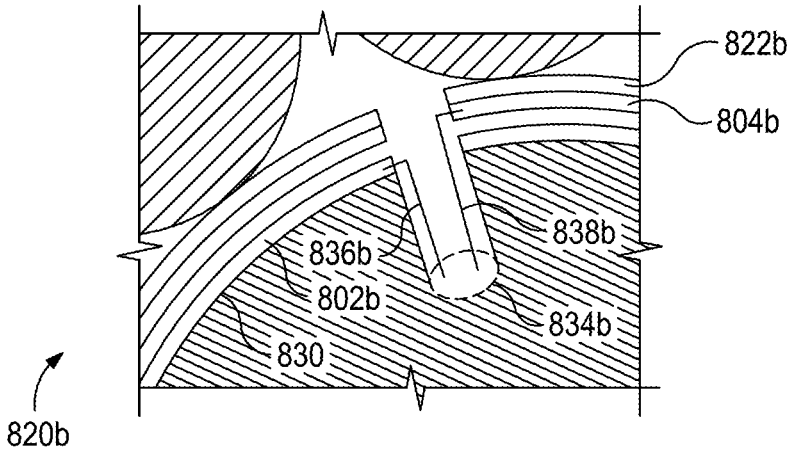
FIG. 8D provides an expanded view of the rolling-element bearing of FIG. 8A of the second strain gauge disposed on the inner race at a port.

FIG. 8D provides an expanded view of a portion of the second strain gauge 820*b* as disposed on the inner race 830 at the port 834*b*. As illustrated, the strain gauge 820*b* includes a first substrate 802*b* disposed on the inner race 830 and a second substrate 804*b* radially offset therefrom towards the outer race 828 and otherwise disposed on a support 822*b*. Electrical connections 836*b*,838*b* may extend from the first and second substrates 802*b*,804*b*, respectively, and into the port 834*b*. Similar to the embodiment described in FIG. 8C, the electrical connections 836*b*,838*b* may extend through the port 834*b* to an electrical resistance sensor 813 (not shown) for measuring and optionally analyzing the resistance or resistance changes to individual circuits of the strain gauge 820*b*.

In an alternative embodiment, a rolling-element bearing similar to the rolling-element bearing 826 of FIG. 8A may include only the first strain gauge 820*a* disposed on the outer race 828 at port 834*a*. In yet another alternative embodiment, a rolling-element bearing similar to that illustrated in FIG. 8A may include only the second strain gauge 820*b* disposed on the inner race 830 at port 834*b*.

Examples of downhole tools that may incorporate or otherwise use rolling-element bearings include, but are not limited to, drill bits, drilling motors, a bottom hole assembly for directional drilling, rotatable pipe connectors, tubular swivel joints, rotary steerable systems, drill stabilizers, and centralizers with rollers, and the like.

Figure 9A:
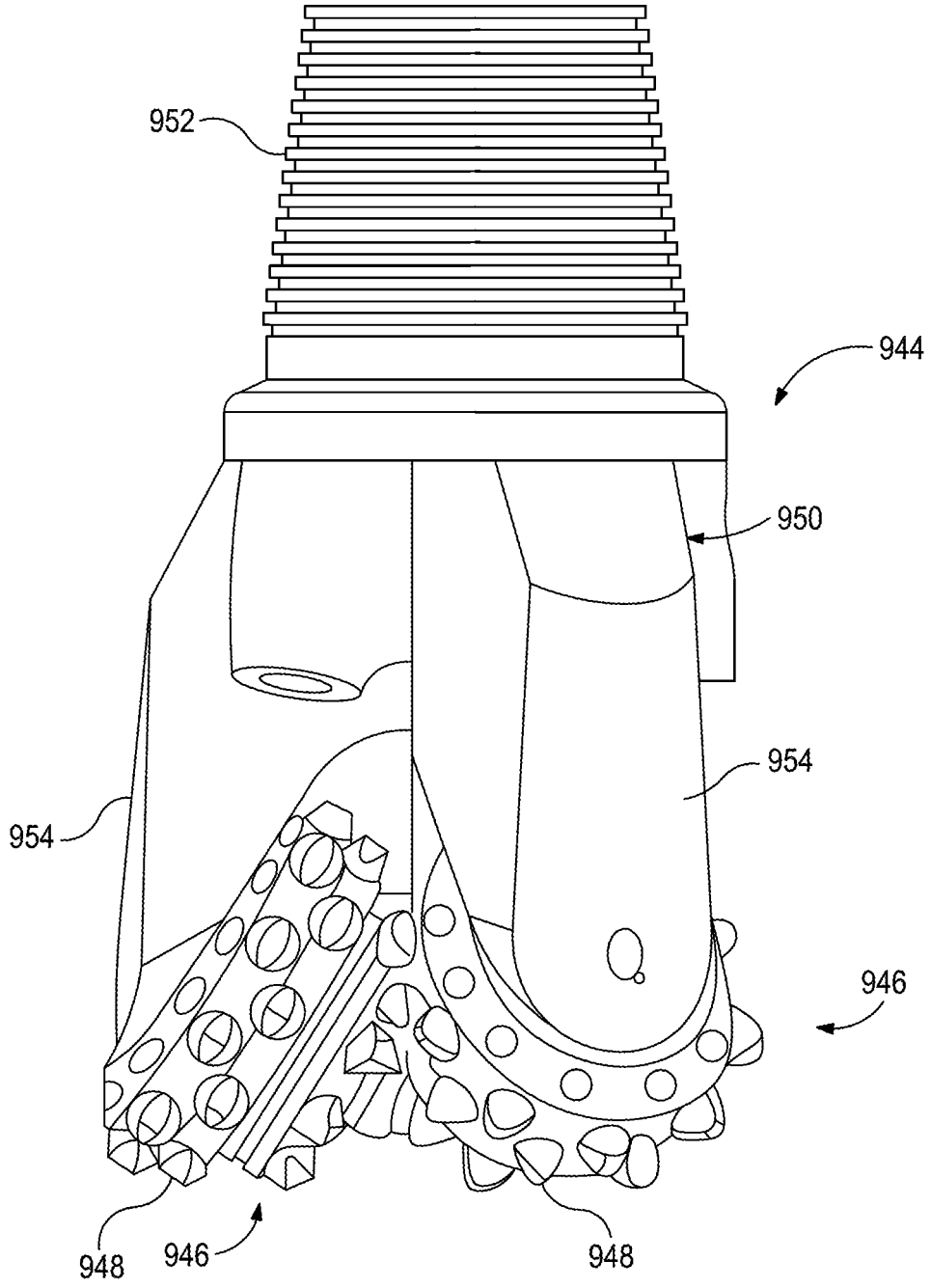
FIG. 9A illustrates an isometric view of a roller cone drill bit.

FIG. 9A illustrates an isometric view of a roller cone drill bit 944. The roller cone drill bit 944 includes a bit body 950 having a tapered, externally threaded portion 952 adapted to be secured to one end of a drill string. The bit body 950 further includes three support arms 954 extending therefrom that each receive a cone assembly 946 having one or more cutting elements 948.

Figure 9B:
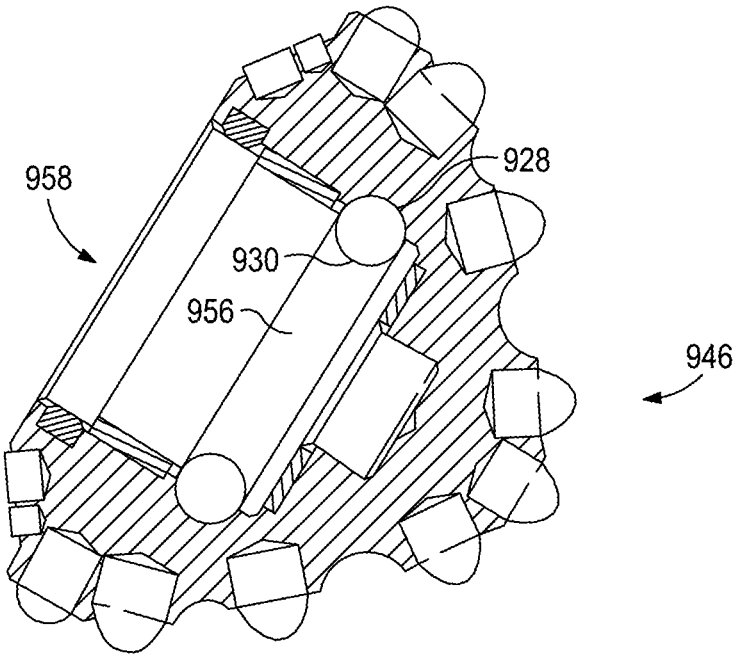
FIG. 9B illustrates a cross-sectional view of rolling-element bearing at a cone assembly of the roller cone drill bit of FIG. 9A.

FIG. 9B illustrates a cross-sectional view of a rolling-element bearing 956 that may be included in a cone assembly 946 of the roller cone drill bit 944 of FIG. 9A. The rolling-element bearing 956 may be positioned within the cone assembly 946 and a spindle 958, which extends from a support arm 954 of FIG. 9A. As illustrated, the rolling-element bearing 956 may include an inner race 930, an outer race 928, and a plurality of bearings (not shown) disposed between the inner and outer races 930, 928. FIG. 9A illustrates three support arms 954 with corresponding cone assemblies 946, which provides for three rolling-element bearings 956 in the roller cone drill bit 944.

The rolling-element bearing 956 may be similar in some respects to the rolling-element bearing 826 of FIGS. 8A-D. Accordingly, in at least one embodiment, one or more strain gauges may be included in the roller cone drill bit 944 at the inner race 930, the outer race 928, or both of the rolling-element bearings 956. Such strain gauges may be similar in structure and function to the strain gauges 520, 620, 720 of FIGS. 5-7, respectively.

One or more strain gauges may be included in one or more of the three rolling-element bearings 956 in the roller cone drill bit 944 illustrated in FIG. 9A.

Roller cone drill bits, such as the roller cone drill bit 944 of FIGS. 9A-B, typically form wellbores by crushing or penetrating a formation and scraping or shearing formation materials from the bottom of the wellbore using cutting elements (e.g., cutting elements 948). Including at least one strain gauge in each of the three rolling-element bearings 956 associated with the individual cone assemblies 946 may allow for analyzing the mechanical loads on the individual cone assemblies 946. This information may allow for actively balancing and equalizing the load among the individual cone assemblies 946 by changing drilling parameters, which may enhance the lifetime of the roller cone drill bit 944 while also increasing the rate of penetration into the formation. Exemplary drilling parameters that may be adjusted include, but are not limited to, weight-on-bit, revolutions per minute of the drill bit, torque, angle of drilling, and any combination thereof.

Figure 10:
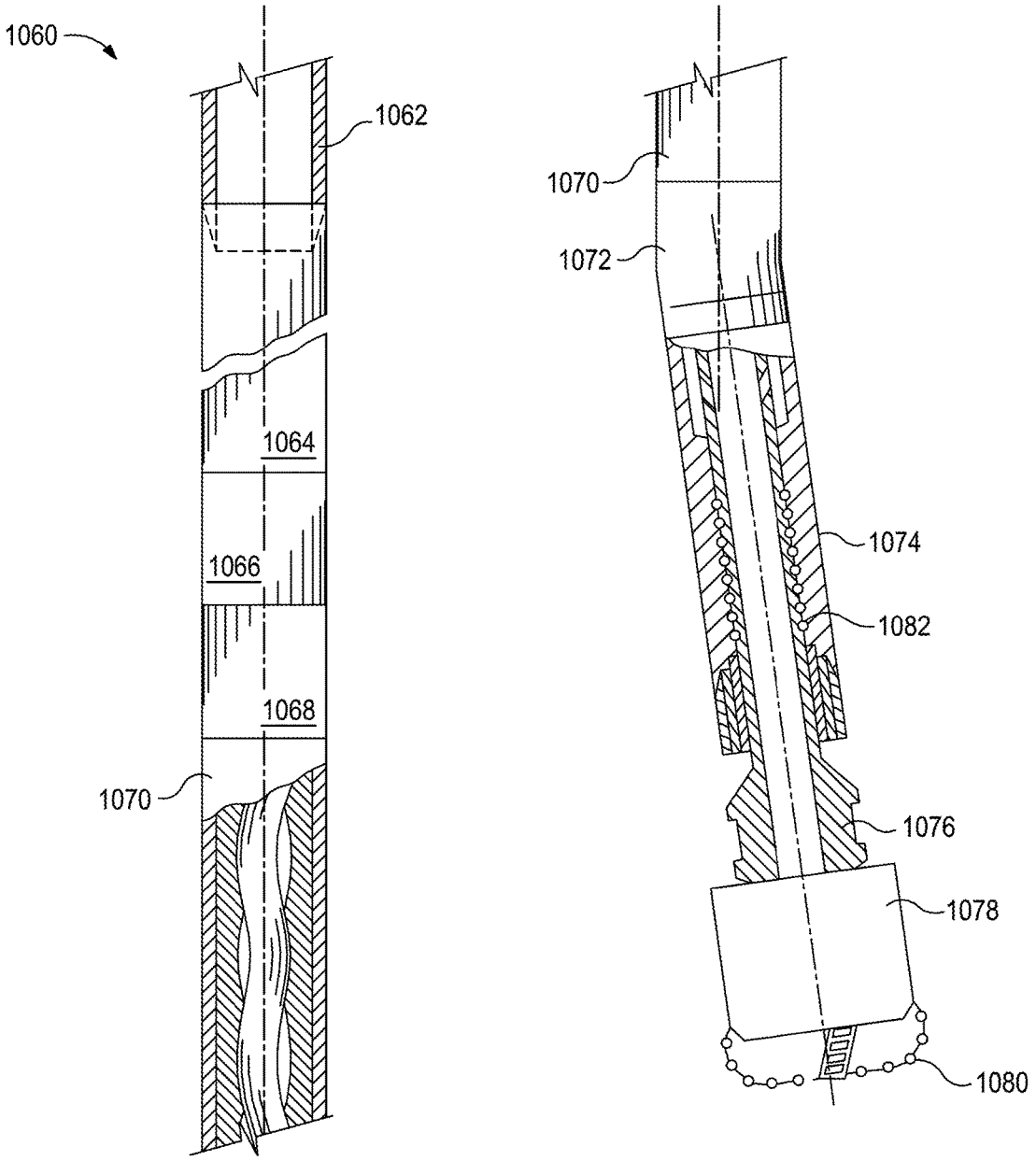
FIG. 10 illustrates a portion of a bottom hole assembly for drilling deviated wellbores.

FIG. 10 illustrates a portion of a bottom hole assembly 1060 for drilling deviated wellbores. As illustrated, the bottom hole assembly 1060 may include several sections, and one skilled in the art would recognize the various configurations thereof. As illustrated, for example, the bottom hole assembly 1060 may include a drill string 1062, a drill collar assembly 1064, a measurement while drilling (MWD) system 1066 (which may include an electrical resistance sensor like those described in FIGS. 1 and 8C), an orientation tool 1068, a positive displacement motor 1070, a bent housing 1072, a lower bearing housing 1074, a motor shaft 1076, a long gauge section 1078, and a drill bit 1080. The lower bearing housing 1074 may house a bearing package assembly 1082 that includes both thrust bearings and radial bearings, which individually may incorporate strain gauges (e.g., strain gauges similar to those described at reference numbers 520, 620, 720 of FIGS. 5-7) in configurations described relative to FIGS. 8A-D.

The measured loads may be visualized at the surface and integrated into drilling models, which may provide a more accurate representation of a drilling operation in real time. In some instances, the measured loads may be used to calculate the real time stresses on the bottom hole assembly 1060, which may be used to adjust drilling parameters before a threshold load is reached that may stop or delay drilling. Exemplary drilling parameters that may be adjusted may include, but are not limited to, weight-on-bit, revolutions per minute of the drill bit, torque, angle of drilling, and the like, and any combination thereof.

As described above specifically relating to roller cone drill bits and bottom hole assemblies, the resistance or resistance changes of individual circuits may be used to measure or analyze a load applied to the strain gauge within a rolling-element bearing. Analysis of the load applied may then be used to take an action that changes the load (either increases or decreases the load) to mitigate tool wear or failure and enhance a drilling operation. This general concept may be applied to other downhole tools. Further, a drilling operation may include several downhole tools with strain gauges within rolling-element bearings to provide load data for each downhole tool, which can be analyzed and correlated to change drilling parameters for more efficient drilling operations that have reduced wear on the downhole tools.

In some instances, changing a drilling parameter may be automated. For example, load thresholds (i.e., resistance thresholds or resistance change thresholds) may be set by an operator for each strain gauge or individual circuits therein. Then, drilling parameters may be changed automatically through a computer program to maintain the loads within the prescribed load thresholds.

Alternatively or in combination, a computer program may provide a readout of the loads relative to the prescribed load thresholds for operators to monitor the loads and take corrective action as needed. Such readouts may be numerical, graphical, pictorial (e.g., a picture of the drilling system with the strain gauges identified thereon with colors coordinated to the proximity of a load to the load thresholds), or a hybrid thereof.

Figure 11:
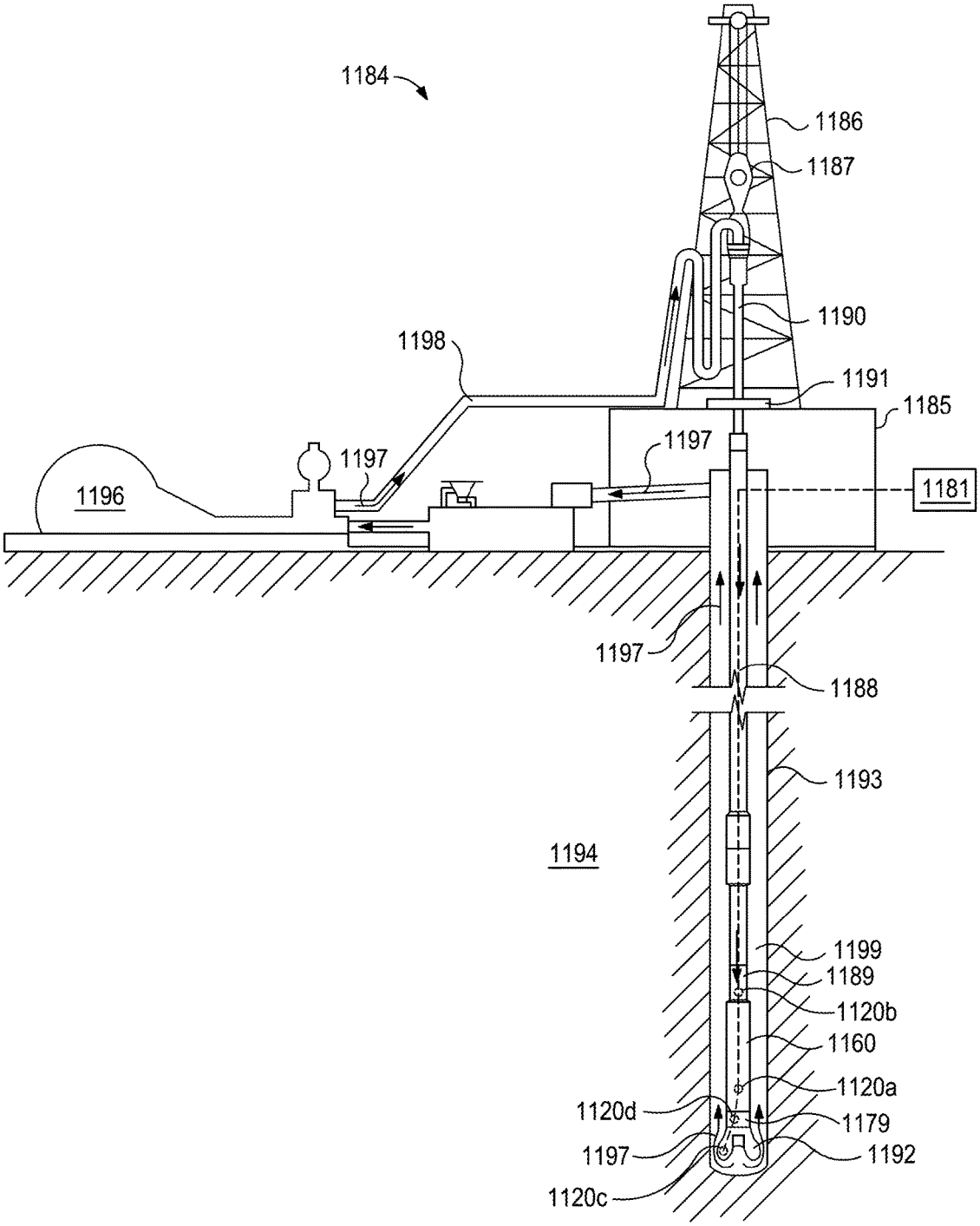
FIG. 11 illustrates a drilling system that includes downhole tools with strain gauges incorporated therewith.

FIG. 11 illustrates a drilling system 1184 that includes various downhole tools having corresponding strain gauges 1120*a*-*d* incorporated therewith. As illustrated, the drilling system 1184 may include a drilling platform 1185 that supports a derrick 1186 having a traveling block 1187 for raising and lowering a drill string 1188. The drill string 1188 may include, but is not limited to, drill pipe and coiled tubing, as generally known to those skilled in the art. For example, the drill string 1188 may include a bottom hole assembly 1160 similar to that illustrated as 1060 in FIG. 10 that includes a first strain gauge 1120*a*. Additionally, the drilling string 1188 may include other downhole tools like a drill collar 1189 that includes a roller bearing element with a second strain gauge 1120*b*, which may be configured within the drill collar 1189 similar to that discussed at FIGS. 8A-D.

A kelly 1190 supports the drill string 1188 as it is lowered through a rotary table 1191. A drill bit 1192 with a third strain gauge 1120*c* is attached to the distal end of the drill string 1188 and, as illustrated, is driven by a downhole motor 1179 with a fourth strain gauge 1120*d*. Alternatively, the drill bit 1192 may be driven via rotation of the drill string 1188 from the well surface. The driven drill bit 1192 then creates a port 1193 that penetrates various subterranean formations 1194.

A pump 1196 (e.g., a mud pump) circulates drilling fluid 1197 through a feed pipe 1198 and to the kelly 1190, which conveys the drilling fluid 1197 downhole through the interior of the drill string 1188 and through one or more orifices in the drill bit 1192. The drilling fluid 1197 is then circulated back to the surface via an annulus 1199 defined between the drill string 1188 and the walls of the port 1193.

Each strain gauge 1120*a-d* may be communicably coupled (wired, wirelessly, or a hybrid thereof) to a control system 1181, which is illustrated at or near the drilling platform 1185, but may include additional components along the drill string 1188 that perform data analysis, provide communication, and execute other functions as needed. The control system 1181 may analyze the data received from the strain gauges 1120*a-d* and, as described above, change drilling parameters, produce a readout, or both.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

Embodiments disclosed herein include Embodiment A, Embodiment B, and Embodiment C.

Embodiment A: A downhole drilling tool that includes a rolling-bearing element having an inner race, an outer race, and one or more bearings disposed between the inner and outer races; and a strain gauge disposed on an interior surface of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection.

Embodiment A may have one or more of the following additional elements in any combination: Element A1: wherein the interior surface corresponds to the outer race of the rolling-element bearing; Element A2: wherein the interior surface corresponds to the inner race of the rolling-element bearing; Element A3: wherein the strain gauge is a first strain gauge and the interior surface corresponds to the outer race of the rolling-element bearing, and wherein the downhole drilling tool further comprises a second strain disposed on a second interior surface corresponding to the inner race of the rolling-element bearing; Element A4: wherein at least one of the first and second conductive fibers are formed by a conductive material; Element A5: wherein at least one of the first and second conductive fibers are formed by a nonconductive material and having a coating of a conductive material disposed thereon; Element A6: wherein at least one of the first and second substrates are formed by a conductive material; Element A7: wherein at least one of the first and second substrates are formed by a nonconductive material with a coating of a conductive material; Element A8: wherein the downhole drilling tool is a roller cone drill bit and the rolling-element bearing is positioned within a cone assembly and a spindle of a roller cone drill bit; Element A9: Element A8 further including one or more additional rolling-element bearings and one or more additional strain gauges positioned within additional cone assemblies and spindles of the roller cone drill bit; Element A10 wherein the rolling-element bearing is positioned within a bottom hole assembly for directional drilling, wherein the rolling-element bearing is a first rolling-element bearing, wherein the bottom hole assembly includes a bearing package assembly having a plurality of rolling-element bearings that include thrust bearings and radial bearings, and wherein one of the plurality of rolling-element bearings is the first rolling-element bearing; and Element A11: Element A10, wherein the strain gauge is a first strain gauge, wherein the first rolling-element bearing is one of the thrust bearings having the first strain gauge disposed therein, and wherein a second rolling-element bearing is one of the radial bearings having a second strain gauge disposed on an interior surface of the second rolling-element bearing.

By way of non-limiting example, exemplary combinations applicable to Embodiment A include: combinations of Element A4 in combination with Element A6; Element A4 in combination with Element A7; Element A5 in combination with Element A6; Element A5 in combination with Element A7; one of Elements A1-A3 in combination with one of the foregoing; and one of Elements A8-A11 in combination with one of the foregoing.

Embodiment B: A drilling system that includes a drill string extending into a wellbore penetrating a subterranean formation and including at least a downhole tool having a rolling-bearing element; and a strain gauge coupled to the rolling-bearing element, the rolling-bearing element having an inner race, an outer race, and one or more bearings disposed between the inner and outer races, and the strain gauge being disposed on an interior surface of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection.

Embodiment B may have one or more of the following additional elements in any combination: Element B1: wherein the downhole drilling tool is a roller cone drill bit and the rolling-element bearing is positioned within a cone assembly and a spindle of a roller cone drill bit; Element B2: wherein the rolling-element bearing is a first rolling-element bearing, wherein the downhole tool is a bottom hole assembly with a bearing package assembly having a plurality of rolling-element bearings that include thrust bearings and radial bearings, and wherein one of the plurality of rolling-element bearings is the first rolling-element bearing; Element B3: Element B2 wherein the strain gauge is a first strain gauge, wherein the first rolling-element bearing is one of the thrust bearings having the first strain gauge disposed therein, and wherein a second rolling-element bearing is one of the radial bearings having a second strain gauge disposed on an interior surface of the second rolling-element bearing; Element B4: wherein at least one of the first and second conductive fibers are formed by a conductive material; Element B5: wherein at least one of the first and second conductive fibers are formed by a nonconductive material with a coating of a conductive material; Element B6: wherein at least one of the first and second substrates are formed by a conductive material; and Element B7: wherein at least one of the first and second substrates are formed by a nonconductive material with a coating of a conductive material.

By way of non-limiting example, exemplary combinations applicable to Embodiment B include: combinations of Element B4 in combination with Element B6; Element B4 in combination with Element B7; Element B5 in combination with Element B6; Element B5 in combination with Element B7; and one of Elements B1-B3 in combination with one of the foregoing.

Embodiment C: A method that includes drilling a wellbore penetrating a subterranean formation with a drilling system that includes a drill string extending into a wellbore penetrating a subterranean formation and a downhole tool positioned on the drill string, the downhole tool having a rolling-bearing element and a strain gauge, the rolling-bearing element having an inner race, an outer race, and one or more bearings disposed between the inner and outer races, and the strain gauge being disposed on an interior surface of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection; measuring a resistance or resistance change to the at least one circuit as a load is applied to the strain gauge; and changing a parameter of the drilling based on a measured resistance or resistance change.

Embodiment C may have one or more of the following additional elements in any combination: Element C1: wherein the rolling-element bearing is a first rolling-element bearing and the strain gauge is a first strain gauge, wherein the downhole tool is a roller cone drill bit with three rolling-element bearings including the first rolling-element bearing that are each positioned within a cone assembly and a spindle of a roller cone drill bit, wherein a second and a third rolling-element bearings have a second and a third strain gauge, respectively, disposed on an interior surface of the second and the third rolling-element bearings, the method further including balancing and equalizing the load among the cone assemblies by comparing the measured resistance or resistance change of the first, the second, and the third strain gauges; Element C2: Element C1 wherein the parameter of the drilling is selected from the group consisting of weight-on-bit, revolutions per minute of the drill bit, torque, angle of drilling, and any combination thereof; Element C3: wherein the rolling-element bearing is a first rolling-element bearing, wherein the downhole tool is a bottom hole assembly with a bearing package assembly having a plurality of rolling-element bearings that include thrust bearings and radial bearings, wherein the strain gauge is a first strain gauge, wherein the first rolling-element bearing is one of the thrust bearings having the first strain gauge disposed therein, wherein a second rolling-element bearing is one of the radial bearings having a second strain gauge disposed on an interior surface of the second rolling-element bearing, and the method further including changing an angle of drilling based on the measured resistance or resistance change; Element C4: wherein at least one of the first and second conductive fibers are formed by a conductive material; Element C5: wherein at least one of the first and second conductive fibers are formed by a nonconductive material with a coating of a conductive material; Element C6: wherein at least one of the first and second substrates are formed by a conductive material; and Element C7: wherein at least one of the first and second substrates are formed by a nonconductive material with a coating of a conductive material.

By way of non-limiting example, exemplary combinations applicable to Embodiment C include: combinations of Element C4 in combination with Element C6; Element C4 in combination with Element C7; Element C5 in combination with Element C6; Element C5 in combination with Element C7; and one of Elements C1-C3 in combination with one of the foregoing.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A downhole drilling tool comprising:

a downhole tool having a rolling-element bearing, the rolling-element bearing having an inner race, an outer race, and one or more bearings disposed between the inner and outer races; and a strain gauge disposed on an interior surface of the outer race or the inner race of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection.

2. The downhole drilling tool of claim 1, wherein the interior surface corresponds to the outer race of the rolling-element bearing.

3. The downhole drilling tool of claim 1, wherein the interior surface corresponds to the inner race of the rolling-element bearing.

4. The downhole drilling tool of claim 1, wherein the strain gauge is a first strain gauge and the interior surface corresponds to the outer race of the rolling-element bearing, and wherein the downhole drilling tool further comprises a second strain disposed on a second interior surface corresponding to the inner race of the rolling-element bearing.

5. The downhole drilling tool of claim 1, wherein at least one of the first and second conductive fibers are formed by a conductive material.

6. The downhole drilling tool of claim 1, wherein at least one of the first and second conductive fibers are formed by a nonconductive material and having a coating of a conductive material disposed thereon.

7. The downhole drilling tool of claim 1, wherein at least one of the first and second substrates are formed by a conductive material.

8. The downhole drilling tool of claim 1, wherein at least one of the first and second substrates are formed by a nonconductive material with a coating of a conductive material.

9. The downhole drilling tool of claim 1, wherein the downhole drilling tool is a roller cone drill bit and the rolling-element bearing is positioned within a cone assembly and a spindle of a roller cone drill bit.

10. The downhole drilling tool of claim 9, further comprising one or more additional rolling-element bearings and one or more additional strain gauges positioned within additional cone assemblies and spindles of the roller cone drill bit.

11. The downhole drilling tool of claim 1, wherein the rolling-element bearing is positioned within a bottom hole assembly for directional drilling, wherein the rolling-element bearing is a first rolling-element bearing, wherein the bottom hole assembly includes a bearing package assembly having a plurality of rolling-element bearings that include thrust bearings and radial bearings, and wherein one of the plurality of rolling-element bearings is the first rolling-element bearing.

12. The downhole drilling tool of claim 11, wherein the strain gauge is a first strain gauge, wherein the first rolling-element bearing is one of the thrust bearings having the first strain gauge disposed therein, and wherein a second rolling-element bearing is one of the radial bearings having a second strain gauge disposed on an interior surface of the second rolling-element bearing.

13. A drilling system comprising:

a drill string extending into a wellbore penetrating a subterranean formation and including at least a downhole tool having a rolling-element bearing; and a strain gauge coupled to the rolling-element bearing, the rolling-element bearing having an inner race, an outer race, and one or more bearings disposed between the inner and outer races, and the strain gauge being disposed on an interior surface of the outer race or the inner race of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection.

14. The drilling system of claim 13, wherein the downhole drilling tool is a roller cone drill bit and the rolling-element bearing is positioned within a cone assembly and a spindle of a roller cone drill bit.

15. The drilling system of claim 13, wherein the rolling-element bearing is a first rolling-element bearing, wherein the downhole tool is a bottom hole assembly with a bearing package assembly having a plurality of rolling-element bearings that include thrust bearings and radial bearings, and wherein one of the plurality of rolling-element bearings is the first rolling-element bearing.

16. The drilling system of claim 15, wherein the strain gauge is a first strain gauge, wherein the first rolling-element bearing is one of the thrust bearings having the first strain gauge disposed therein, and wherein a second rolling-element bearing is one of the radial bearings having a second strain gauge disposed on an interior surface of the second rolling-element bearing.

17. A method comprising:

drilling a wellbore penetrating a subterranean formation with a drilling system that includes a drill string extending into a wellbore penetrating a subterranean formation and a downhole tool positioned on the drill string, the downhole tool having a rolling-element bearing and a strain gauge, the rolling-element bearing having an inner race, an outer race, and one or more bearings disposed between the inner and outer races, and the strain gauge being disposed on an interior surface of the outer race or the inner race of the rolling-element bearing, the strain gauge including at least one circuit formed by (1) a first substrate and a second substrate defining a gap therebetween and having first conductive fibers and second conductive fibers, respectively, extending therefrom into the gap in an intermingling configuration, (2) an electrical connection between the first and second substrates, and (3) an electrical resistance sensor arranged within the electrical connection;

measuring a resistance or resistance change to the at least one circuit as a load is applied to the strain gauge; and changing a parameter of the drilling based on a measured resistance or resistance change.

18. The method of claim 17, wherein the rolling-element bearing is a first rolling-element bearing and the strain gauge is a first strain gauge, wherein the downhole tool is a roller cone drill bit with three rolling-element bearings including the first rolling-element bearing that are each positioned within a cone assembly and a spindle of a roller cone drill bit, wherein a second and a third rolling-element bearings have a second and a third strain gauge, respectively, disposed on an interior surface of the second and the third rolling-element bearings, the method further including balancing and equalizing the load among the cone assemblies by comparing the measured resistance or resistance change of the first, the second, and the third strain gauges.

19. The method of claim 18, wherein the parameter of the drilling is selected from the group consisting of weight-on-bit, revolutions per minute of the drill bit, torque, angle of drilling, and any combination thereof.

20. The method of claim 17, wherein the rolling-element bearing is a first rolling-element bearing, wherein the downhole tool is a bottom hole assembly with a bearing package assembly having a plurality of rolling-element bearings that include thrust bearings and radial bearings, wherein the strain gauge is a first strain gauge, wherein the first rolling-element bearing is one of the thrust bearings having the first strain gauge disposed therein, wherein a second rolling-element bearing is one of the radial bearings having a second strain gauge disposed on an interior surface of the second rolling-element bearing, and the method further including changing an angle of drilling based on the measured resistance or resistance change.

* * * * *